US006029129A

United States Patent [19]

Kliger et al.

[11] Patent Number: 6,029,129

[45] Date of Patent: Feb. 22, 2000

[54] QUANTIZING AUDIO DATA USING AMPLITUDE HISTOGRAM

[75] Inventors: Scott A. Kliger, Westborough; Thomas M. Middleton, III, Hingham; Gregory T. White, Bedford, all of Mass.

[73] Assignee: Narrative Communications Corporation, Waltham, Mass.

[21] Appl. No.: 08/861,931

[22] Filed: May 22, 1997

Related U.S. Application Data

[60] Provisional application No. 60/018,297, May 24, 1996.

[51] Int. Cl.[7] ..... G10L 3/02

[52] U.S. Cl. ..... 704/230; 704/224

[58] Field of Search ..... 704/207, 209, 704/221–223, 224, 230, 226–228, 241, 500, 501

[56] References Cited

U.S. PATENT DOCUMENTS

| | | | |
|---|---|---|---|
| 3,803,358 | 4/1974 | Schirf et al. | 704/267 |
| 4,662,635 | 5/1987 | Enokian | 273/94 |
| 4,682,248 | 7/1987 | Schwartz | 360/32 |
| 4,803,729 | 2/1989 | Baker | 704/241 |
| 4,815,134 | 3/1989 | Picone et al. | 704/222 |
| 4,935,963 | 6/1990 | Jain | 704/207 |
| 5,680,508 | 10/1997 | Liu | 704/227 |

*Primary Examiner*—David D. Knepper
*Attorney, Agent, or Firm*—Hamilton, Brook, Smith & Reynolds, P.C.

[57] ABSTRACT

Quantizing optimizes compression encoding for transmission of audio data. A working set of most frequent sound levels in a sequence of audio samples is determined from a histogram. Sound levels from the working set are then substituted for original sound levels in the subject audio data. This filters the audio data by increasing redundancy and decreasing granularity/resolution.

8 Claims, 2 Drawing Sheets

QUANTIZING AUDIO DATA USING AMPLITUDE HISTOGRAM

RELATED APPLICATIONS

This application claims the benefit of a co-pending United States Provisional Application Ser. No. 60/018,297 filed May 24, 1996.

BACKGROUND

A typical computer network system includes a digital processor, main disk for storage and several work stations which are serviced by the digital processor and which share the information stored in the main disk. Each work station is coupled through a communication channel to the digital processor.

There are becoming more and more occasions for the transmission of digital analog signals such as image (video) data and sound (audio) data in such computer network systems. The speed at which image and sound data is transmitted is of paramount importance, particularly in situations where real time and playback is desired. There are generally two solutions that are typically used to decrease transmission time. One solution is to increase the bandwidth of the communication channel between the digital processor and work stations. A second solution is to compress the data prior to transmission. Datacompression in certain cases, however, is only effective if the decompression time is negligible in relation to the time saved in transmitting the data.

There are two main classes of image compression algorithms, known as lossy algorithms and exact algorithms. Lossy algorithms are those that produce a small difference between the original image or sound track and an image or sound track that has undergone a compression-decompression cycle. Exact algorithms are those that leave the image and sound completely unchanged in such a cycle.

Various types of compression encoding are also known in the state of the art. These include Huffman encoding, run length coding and Delta coding schemes. Huffman coding involves a multiplication operation and a variable code word size lookup to be performed for each decompressed sample. Other dictionary based encoding schemes also look at patterns of data and store the most frequently used patterns in a so-called "dictionary". A respective index is then used to look up each entry in the dictionary. To date, the application of these compression techniques to the problem of optimizing transmission of digitalized audio data is in need of improvement.

SUMMARY OF THE INVENTION

The present invention improves and solves the problems of the prior art. In particular, the present invention provides a digital processing system which optimizes the time of audio data transmission. The present invention accomplishes this by a prefiltering of data to smooth the data in a manner which maximizes the standard compression encoding. In particular, the present invention reduces the entropy in the sound sample and increases redundancy.

BRIEF DESCRIPTION OF THE DRAWINGS

The foregoing and other objects, features and advantages of the invention will be apparent from the following more particular description of preferred embodiments and the drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
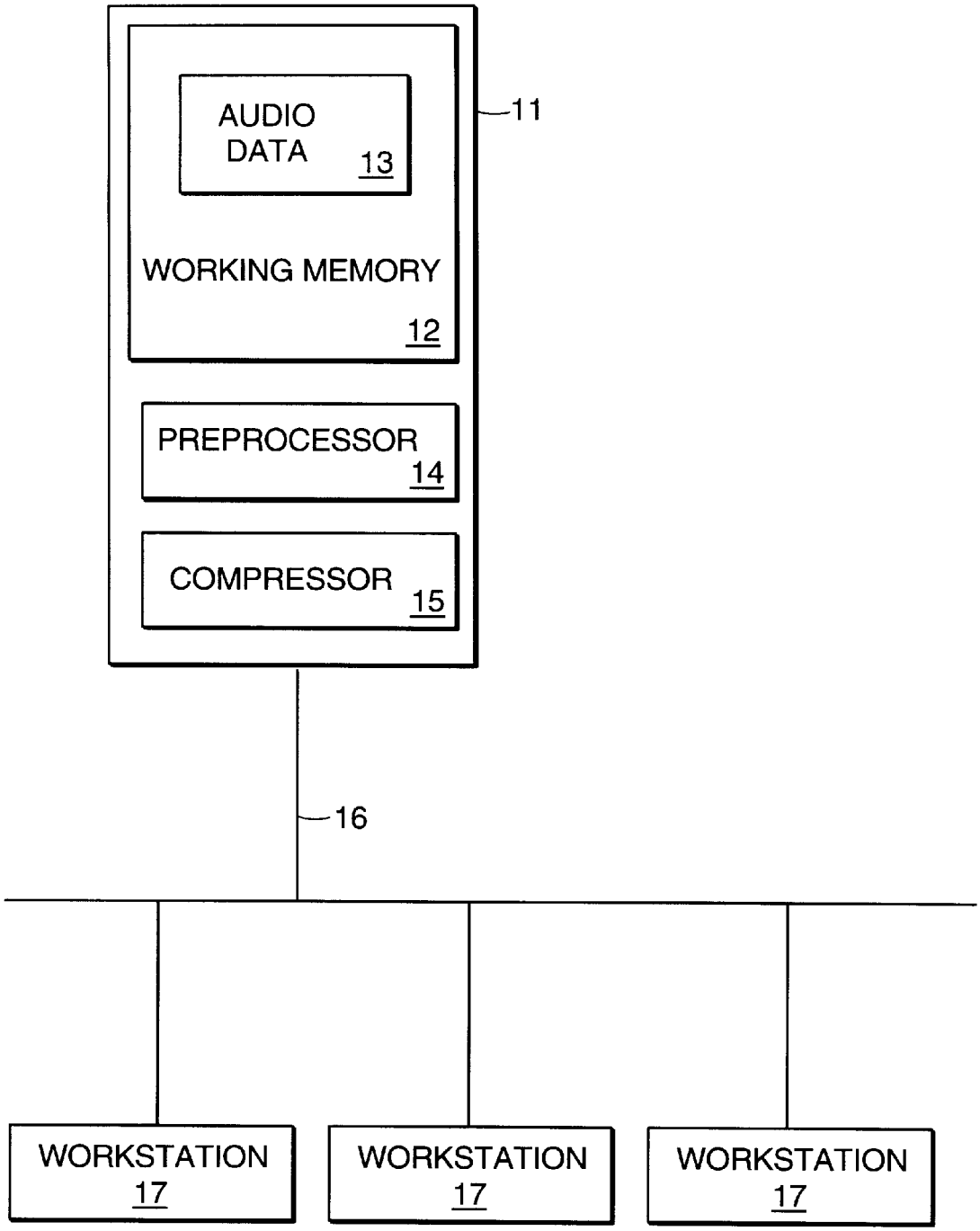
FIG. 1 is a block diagram of a computer system employing the present invention.

Referring now in particular to FIG. 1, in a computer system a digital processor 11 stores in a working memory 12 a sound or audio track in the form of audio track data 13. The digital processor 11 may typically be coupled to a communication channel 16 for transmitting sound and/or other data from the working memory 12 to work stations 17 coupled across the communication channel 16. Also employed in the digital processor 11 are computer programs such as a preprocessor 14 and a compressor 15 for processing and preparing sound data for transmission from the digital processor 11 across a communication channel 16 to desiring work stations 17.

The preprocessor 14, as described below in detail, prefilters the audio data 13 before processing of the data by the compressor 15. In particular, the preprocessor 14 smooths the audio data 13 such that the compressor 15 processing has a maximal effect on the preprocessed audio data (i.e., provides increased or enhanced compression of the audio data 13).

The compressor 15 is of the type standard in the art for compression encoding of audio data 13. Various encoding techniques may be employed by the compressor 15 either independently or in combination as is common in the art. Examples of the types of encoding employed by the compressor 15 include the Huffman, run length, and delta coding schemes.

Based on an understanding of the characteristics of the foregoing compression coding schemes, the present invention quantizes the audio data 13 in the preprocessor 14. This in turn maximizes the performance of the encoding scheme. In the preferred embodiment, the preprocessing of the present invention is a filtering (or prefiltering) of the audio data 13 in a manner which smooths the data.

Figure 2:
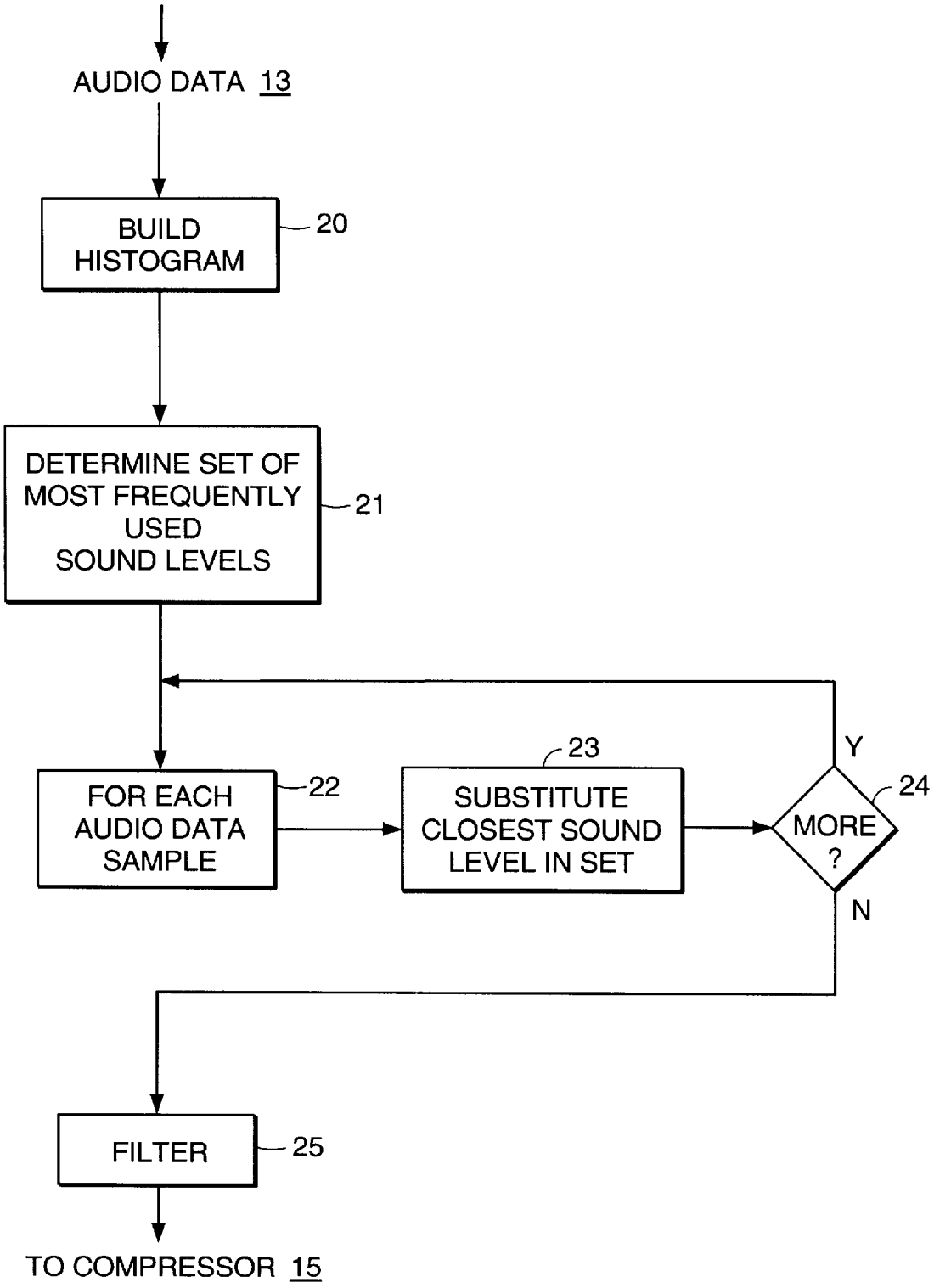
FIG. 2 is a flow diagram of a preferred embodiment of the present invention.

Referring to FIG. 2, the preferred embodiment quantizes the audio data 13 as follows. In a first step 20, the present invention builds a histogram of all the values of a particular sequence of sound samples in the audio data 13. For example, the histogram maps 8-bit sound samples onto a histogram scale from −128 to +128. As a result, the histogram shows which sound sample levels in a sequence are most frequently used.

In a next step 21, a set of most frequently used sound levels is selected from the histogram sound samples. The preferred embodiment selects the 32 most commonly used sound samples. The chosen set of most frequently used sound levels becomes a working set of sound levels which is, as shown in steps 22, 23, and 24, then applied to represent each of the samples in the original audio data 13.

In particular, for each sound sample in a sequence of the audio data 13 samples, the present invention replaces the original sound level with the closest sound level from the working set. Take, for example an audio sample sequence having a sound level pattern of (93, 98, 100, 95). Each of those sound levels are replaced with a numerically closest sound level represented in the working set. So, if the working set included each of the sound levels from 80 to 92 and from 97 to 101, the first sound level (i.e., 93) is replaced with 92, and the fourth sound level (i.e., 95) is replaced with 97, since those are the numerically closest sound levels represented in the working set. The second and third sound levels (i.e., 98 and 100) would not be replaced since those sound levels are in the working set.

In the preferred embodiment, the working set contains up to 32 possible sound levels, for mapping the 8-bit input samples to 5-bit output samples. Processed according to the foregoing steps, the output of the preprocessor 5-bit samples.

Although the length of the audio data 13 is not reduced, a loss in resolution is present. In particular, the resulting representations of the sound samples have a yield dependent on the acceptable loss. Also affecting the amount of loss is the length of the sample sequence submitted to the histogram; the smaller the number of samples, the more lossy the results. The more lossy, the greater is the High Frequency Distortion (HFD). For larger amounts of High Frequency Distortion, a low pass filter may be used in step 25 to reduce the HFD. Also, by reducing the number of histogram bins processed, the bit depth required to represent audio data sample is reduced.

Further reduction in data size can be made dependent on the type of compressor 15 following the preprocessor 14.

The source code of the preferred embodiment for the foregoing processing as depicted in FIG. 2 is attached in Appendix I.

Equivalents

While the invention has been particularly shown and described with reference to a preferred embodiment thereof, it will be understood by those skilled in the art that various changes in form and details may be made therein without departing from the spirit and scope of the invention as defined by the appended claims.

The present invention improves compression of the Huffman encoding type by increasing compression 20 or 30 to 1, where Huffman alone typically provides compression in the range of 2:1 or 4:1.

```
//
// smooth.cpp - Sound Smoothing Algorithem
//
// Copyright (C) 1996 Narrative Communications Corporation.
//
typedef struct histDataTag {
    ulong           usage;
    unsigned char   sample;
} histData;
#pragma optimize("atg", on)
static int histCompare( const void *arg1, const void *arg2 )
{
    histData *h1 = (histData *) arg1;
    histData *h2 = (histData *) arg 2;
    return h2->usage - h1->usage;
}
#define DELTA 8
#pragma optimize ("atg", on)
void MassageSampleTab(histData *data)
{
    int     i, j;
    for(i=0; i < 63; i++) {
        if(!data[i].usage)
            break;
        j = i+1;
        while(j < 254) {
            if(!data[j].usage)
                break;
            if( abs(data[i].sample - data[j].sample) <= DELTA ) {
                histData tmp = data[j];
                memmove(&data[j], &data[j+1], sizeof(data[0]) * (255-j));
                data[255] = tmp;
                data[255].usage = 0;
            }
            else
                j++;
        }
    }
}
void NWave::PrecompressSamples()
{
    unsigned char *p;
    histData usage[256];
    int         i;
    if(m_SamplesMassaged)
        return;
    m_SamplesMassaged = TRUE;
    p = (unsigned char *)m_pSamples;
    for(i=0; i < 256; i++) {
        usage[i].usage = 0;
        usage[i].sample = i;
    }
```

-continued

```
    for(i=0; i < m_iSize; i++)
        usage[p[i]].usage++;
    qsort(usage, 256, sizeof(usage[0]), histCompare);
    MassageSampleTab(usage);
    for(i=0; i < 256; i++) {
        if(!usage[i].usage)
            break;
    }
    int         j, maxJ = i, nearest;
    while(i < 256) {
        nearest = -1;
        for(j=0; j < maxJ; j++) {
            if(nearest < 0 || abs(usage[j].sample - usage[i].sample) < abs(nearest -
usage[i].sample))
                nearest = usage[j].sample;
        }
        for(int q=0; q < m_iSize; q++) {
            if(p[q] == usage[i].sample)
                p[q] = nearest;
        }
        i++;
    }
}
#pragma optimize("",off)
void NWave::Serialize(CArchive& ar)
{
    ulong    ulTag;
// ar.Flush( );
  CFile* fp = ar.GetFile( );
    if(ar.IsStoring( )) {
        NObject::Serialize(ar);
        ulTag = 'EVWN';
        ar << ulTag;
        ar << m_iSize;
        ar.Write(&m_pcmfmt,    sizeof(m_pcmfmt));
//      Play( );
        PrecompressSamples( );
#ifdef PALETTIZE_WAVES
        NPalettizer nbp(m_iSize);
        nbp.Palettize((uchar *)m_pSamples);
  printf("Palletized: StorageLength %d->% d\n", m_iSize, nbp.StorageLength( ));
        nbp.Serialize(ar);
#else
        ar.Write(m_pSamples, m_iSize);
#endif
//      Play( );
    }
    else {
        ar >> ulTag;
        ASSERT(ulTag == 'EVWN');
        ar >> m_iSize;
        if(m_pSamples);
            FREE(m_pSamples);
        m_pSamples = ALLOC(m_iSize);
        ASSERT(m_pSamples);
        ar.Read(&m_pcmfmt, sizeof(m_pcmfmt));
#ifdef PALETTIZE_WAVES
        NPalettizer nbp(m_iSize);
    nbp.Serialize(ar);
#else
        ar.Read(m_pSamples, m_iSize);
#endif
        // nbp.UnPalettize(m_pSamples)
//      ar.Write(m_pSamples, m_iSize);
    }
#if OLD_WAY
  if (ar.IsStoring( )) {
   ASSERT(0); // Save(fp);
  } else {
   Load(fp);
  }
#endif
}
int NWave::StorageLength( )
{
#ifdef PALETTIZE_WAVES
    PrecompressSamples( );
    NPalettizer nbp(m_iSize);
    nbp.Palettize((uchar *)m_pSamples);
```

-continued

```
    return (sizeof(ulong) + sizeof(m_iSize) + sizeof(m_pcmfmt) + nbp.StorageLength( ));
#else
    return (sizeof(ulong) + sizeof(m_iSize) + sizeof(m_pcmfmt) + m_iSize);
#endif
}
```

What is claimed is:

1. In a digital processor, apparatus for transmitting audio data comprising:

a receiver coupled to receive audio data, the audio data being formed of a sequence of sound samples, each sound sample being one of a plurality of sound levels;

a preprocessor coupled to receive the audio data from the receiver, the preprocessor further comprising:

means for determining a working set of most frequent sound levels used in the sequence of sound samples of the audio data; and a sample substituter coupled to the means for determining a working set, and for each sound sample, the sample substituter substituting original sound levels with sound levels from the working set to form a working set level substituted version of the audio data; and compression means coupled to the sample substituter for receiving the working set level substituted version of the audio data, the compression means for compression encoding the audio data to form compressed data.

2. Apparatus as claimed in claim 1 wherein the preprocessor employs a histogram to determine the working set of most frequent sound levels.

3. Apparatus as claimed in claim 1 wherein the compression means employs one of Huffman encoding, run length encoding and delta encoding.

4. An apparatus as claimed in claim 1 further comprising:

a low pass filter connected to receive input from the sample substituter and sending output to the compression means wherein the low pass filter acts upon the working set level substituted audio data to remove high frequency distortion.

5. In a digital processor, a method for compressing audio data for transmission thereof across a communication channel coupled to the digital processor, comprising the steps of:

receiving audio data, the audio data being formed of a sequence of sound samples, each sound sample being one of a plurality of sound levels;

determining a working set of most frequent sound levels used in the sound samples of the audio data;

substituting original sound levels in the sound samples of the audio data with sound levels from the working set; and compression encoding the working set level substituted audio data.

6. A method as claimed in claim 5 wherein the step of determining a working set includes forming a histogram of the sound levels found in the sound samples of the audio data.

7. A method as claimed in claim 5 wherein the step of substituting includes, for each sound sample, substituting numerically closest sound levels in the working set for the original sound levels in the sound sample.

8. A method as claimed in claim 4 further comprising the step of:

filtering the working set level substituted audio data using a low pass filter to remove high frequency distortion.

* * * * *